US009433997B2

(12) United States Patent
Lee et al.

(10) Patent No.: US 9,433,997 B2
(45) Date of Patent: Sep. 6, 2016

(54) INORGANIC BINDER COMPOSITION FOR CASTING

(71) Applicant: DR AXION CO., LTD., Busan (KR)

(72) Inventors: Man Sig Lee, Yangsan-si (KR); Min A Bae, Daegu (KR); Myung Hwan Kim, Yangsan-si (KR); Sang Ho Ha, Busan (KR)

(73) Assignee: DR AXION CO., LTD., Busan (KR)

( * ) Notice: Subject to any disclaimer, the term of this patent is extended or adjusted under 35 U.S.C. 154(b) by 0 days.

(21) Appl. No.: 14/953,618

(22) Filed: Nov. 30, 2015

(65) Prior Publication Data

US 2016/0167113 A1 Jun. 16, 2016

(30) Foreign Application Priority Data

Dec. 16, 2014 (KR) ..... 10-2014-0181648

(51) Int. Cl.

| | |
|---|---|
| ***B22C 1/16*** | (2006.01) |
| ***B22C 9/06*** | (2006.01) |
| ***B22C 9/10*** | (2006.01) |
| ***B22D 15/00*** | (2006.01) |

(52) U.S. Cl.

CPC ..... *B22C 1/167* (2013.01); *B22C 9/06* (2013.01); *B22C 9/10* (2013.01); *B22D 15/00* (2013.01)

(58) Field of Classification Search

CPC ..... B22C 1/167; B22C 9/06; B22C 9/10; B22D 15/00

See application file for complete search history.

(56) References Cited

U.S. PATENT DOCUMENTS

| | | | | |
|---|---|---|---|---|
| 4,162,238 | A * | 7/1979 | Bergna | B22C 1/02 106/38.35 |
| 4,316,744 | A * | 2/1982 | Bergna | B22C 1/02 106/197.01 |
| 8,006,745 | B2 | 8/2011 | Gerlach et al. | |
| 8,567,481 | B2 | 10/2013 | Garcia-Tapia et al. | |
| 2005/0121110 | A1* | 6/2005 | Dallam | B23K 35/365 148/23 |
| 2010/0326620 | A1 | 12/2010 | Muller et al. | |
| 2011/0100255 | A1 | 5/2011 | Kim et al. | |
| 2011/0251045 | A1* | 10/2011 | Saito | B82Y 30/00 501/125 |
| 2014/0352910 | A1* | 12/2014 | Kloskowski | B22C 3/00 164/369 |
| 2016/0059301 | A1* | 3/2016 | Muller | B22C 1/188 164/525 |
| 2016/0158828 | A1* | 6/2016 | Tanaka | B22C 9/02 164/12 |

FOREIGN PATENT DOCUMENTS

| | | | |
|---|---|---|---|
| EP | 1 057 554 | B1 | 12/2000 |
| KR | 10-2010-0093546 | A | 8/2010 |
| KR | 10-1027030 | B1 | 3/2011 |
| KR | 10-2011-0106372 | A | 9/2011 |
| KR | 10-1199111 | B1 | 11/2012 |
| KR | 10-2013-0102982 | A | 9/2013 |

OTHER PUBLICATIONS

Derwent-Acc-No. 2013-K14957, abstract of Korean Patent Specification No. KR 2013048742 A (May 2013).*

Derwent-Acc-No. 2016-21214M, abstract of Korean Patent Specification No. KR 2015028188 A (Mar. 2015).*

Bibliographic data, Document EP000001057554A2, including English Abstract on p. 2, 2 pages total, Jun. 2000.

Bibliographic data, Document KR102013102982A, including English Abstract on p. 1, 2 pages total, Sep. 2013.

* cited by examiner

*Primary Examiner* — Anthony J Green

(74) *Attorney, Agent, or Firm* — Ware, Fressola, Maguire & Barber LLP

(57) ABSTRACT

The present disclosure relates to an inorganic binder composition for casting, including: water glass of 40 to 70 parts by weight; nano-silica of 5 to 35 parts by weight; a Li-based water resistant additive of 0.1 to 10 parts by weight; an organic silicon compound of 0.1 to 10 parts by weight; and an anti-sand burning additive of 1 to 10 parts by weight. Furthermore, the present disclosure relates to a core manufactured by using the inorganic binder composition and a cast manufactured so as to include the core.

7 Claims, 5 Drawing Sheets

INORGANIC BINDER COMPOSITION FOR CASTING

CROSS-REFERENCE TO RELATED APPLICATION

This application claims priority to and the benefit of Korean Patent Application No. 2014-0181648, filed on Dec. 16, 2014, the disclosure of which is incorporated herein by reference in its entirety.

BACKGROUND

1. Field of the Invention

The present disclosure relates to an inorganic binder composition for casting, and more particularly to an eco-friendly inorganic binder composition for casting which is supplemented in strength and water resistance so as to be suitable for a climate of high temperature and high humidity and improved in sand burning by including nano-silica, a Li-based water resistant additive, an organic silicon compound, and an anti-sand burning additive in water glass.

2. Description of the Related Art

Korean casting foundry industry has greatly contributed to all kinds of industries including shipbuilding industry, auto-parts industry, industrial machine industry, construction machine industry, and the like. Although the casting foundry industry is an important basic industry indispensable for the development of national industry, the current environment surrounding the casting foundry industry, such as environmental problems, price fluctuations in subsidiary materials, policies, lack of manpower, and the like, is not very good. Above all, the environmental problems have been set as a priority to be solved. Currently, in the casting industry, environmental pollution has been improved in order to block discharge of environmental pollutants generated during a metal dissolution process, a core manufacturing process, and a casting process. However, since the casting industry has been regulated in greenhouse gas emission by the Muskie Act, the Kyoto Protocol, and the like, a method for getting rid of discharge of basic pollutants and a technical method for reduction in energy consumption, improvement in working environment, and greening of manufacturing sites have been urgently needed.

That is, an organic binder has been widely used for years from mass production to molding of a small-sized product and a multi-shaped core, but the organic binder generates toxic steam during molding of a core and also generates a VOC material such as benzene and carbon dioxide during disassembling of a cast, and, thus, has a bad influence on the environment. Furthermore, the organic binder requires a large amount of thermal energy for sintering, and it is difficult to reclaim sand due to a residue of ash or carbon within a molded object. Accordingly, an eco-friendly inorganic binder has been developed in order to solve the environmental problem and improve productivity of cores.

An inorganic binder makes it possible to perform a curing process at a low temperature and does not generate a toxic substance, and, thus, a working environment is kept in a good condition. Furthermore, just a small amount of a gas is generated during a manufacturing process of a core and a casting process, and, thus, defects in casting are reduced, and there is no need to install an anti-environmental pollution system, and, thus, manufacturing costs can be reduced.

In this regard, Korean Patent Laid-open Publication No. 10-2011-0106372 discloses a technique of using an inorganic binder for manufacturing a sand cast and a core by mixing sand with sodium hydroxide and tetraethylsilicate. Furthermore, Korean Patent No. 10-1027030 discloses a technique of using a suspension including a sodium hydroxide solution, alkali silicate with a solid content of 70%, and amorphous spherical silicon dioxide, and European Patent No. 1057554 discloses a technique for producing a casting mold and a core by using a two-component binder system including alkyl silicate and an alkyl silicate oligomer.

However, the above-described inorganic binder has been developed by adding various additives into water glass as a main material and it is eco-friendly and improved in moldability and fluidity, but weak in water resistance due to a hygroscopic property of the water glass. Therefore, the above-described inorganic binder has problems of swelling, a decrease in strength, and elution caused by moisture, and, thus, cannot be used in a climate of high temperature and high humidity.

Furthermore, the inorganic binder for casting is in liquid form based on the water glass ($xSiO_2$-$yNa_2O$) and lacks a thermal property and thermal resistance. Thus, there occurs sand burning caused by the remaining sand on a metal surface during disassembling of a cast.

In this regard, Korean Patent Laid-open Publication No. 10-2013-0102982 discloses a technique for preventing sand burning by adding spherical iron oxide. Furthermore, Korean Patent No. 10-1027030 discloses a technique for increasing the strength of a core and preventing sand burning by separately inputting $SiO_2$ dispersed in a liquid.

As described above, a technique for preventing sand burning by adding a granular anti-sand burning additive has greatly contributed to commercialization of eco-friendly inorganic binders, but the use thereof has been avoided in the industrial site due to addition of a process in view of productivity and safety in management of additives and storage of binders.

Therefore, in view of the foregoing, the inventors of the present disclosure developed a commercializable eco-friendly inorganic binder composition for casting which has a good fluidity and is supplemented in strength and water resistance so as to be suitable for a climate of high temperature and high humidity and improved in sand burning by including nano-silica, a Li-based water resistant additive, an organic silicon compound, and an anti-sand burning additive in water glass, and completed the present disclosure.

SUMMARY

Accordingly, one object of the present disclosure is to provide an inorganic binder composition for casting.

Another object of the present disclosure is to provide a core manufactured by using the inorganic binder composition for casting.

Yet another object of the present disclosure is to provide a cast manufactured so as to include the core.

According to an aspect to achieve an object of the present disclosure, there is provided an inorganic binder composition for casting, including: water glass of 40 to 70 parts by weight; nano-silica of 5 to 35 parts by weight; a Li-based water resistant additive of 0.1 to 10 parts by weight; an organic silicon compound of 0.1 to 10 parts by weight; and an anti-sand burning additive of 1 to 10 parts by weight.

According to another aspect to achieve an object of the present disclosure, there is provided a core manufactured by using the inorganic binder composition for casting.

According to yet another aspect to achieve an object of the present disclosure, there is provided a cast manufactured so as to include the core.

According to the present disclosure, the inorganic binder composition for casting supplements the strength and water resistance by increasing an amount of Si while maintaining the fluidity of mixed sand when a sand cast and a core are manufactured, and, thus, work efficiency is improved and the inorganic binder can be commercialized.

Furthermore, as the inorganic binder is used, the sand cast and the core can be eco-friendly manufactured.

Furthermore, as the inorganic binder composition for casting according to the present disclosure is used, surface energy between molten metal and a cast is decreased when the cast is manufactured and sand burning is prevented by carbonization of saccharides caused by the hot molten metal.

DETAILED DESCRIPTION OF THE PREFERRED EMBODIMENTS

Figure 1:
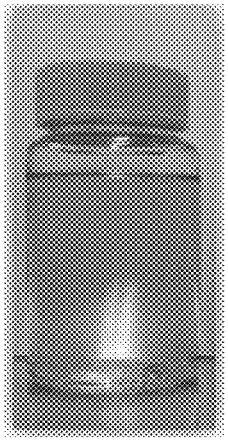
FIG. 1 is a photo of an inorganic binder dissolved in an aqueous solution prepared according to one embodiment of the present disclosure.

The present disclosure relates to an inorganic binder composition for casting, and more particularly to an eco-friendly inorganic binder composition for casting which is supplemented in strength and water resistance so as to be suitable for a climate of high temperature and high humidity and improved in sand burning by including nano-silica, a Li-based water resistant additive, an organic silicon compound, and an anti-sand burning additive in water glass.

Hereinafter, the present disclosure will be described in more detail.

According to an aspect, the present disclosure relates to an inorganic binder composition for casting, including: water glass of 40 to 70 parts by weight; nano-silica of 5 to 35 parts by weight; a Li-based water resistant additive of 0.1 to 10 parts by weight; an organic silicon compound of 0.1 to 10 parts by weight; and an anti-sand burning additive of 1 to 10 parts by weight.

To be specific, the water glass includes $SiO_2$ of 25 to 36 weight % and $Na_2O$ of 7 to 15 weight %.

Furthermore, the nano-silica is a silicon dioxide ($SiO_2$) particle having a structure of 5 to 20 nanometers in size, and micro pores are formed to be parallel to a particle surface or the pores have irregular directions. Thus, it is difficult for a foreign substance to enter the inside of the pores. Furthermore, when the nano-silica is synthesized with the water glass, the strength can be improved by increasing the amount of Si, and the water resistance and water repellency of a binder composition can be improved due to a structure of the nano-silica particle. Herein, if the nano-silica is included in an amount of more than 35 parts by weight, the fluidity of the inorganic binder is decreased and the excess of silica particles inhibits a curing process. Therefore, preferably, the nano-silica may be included in an amount of 5 to 35 parts by weight.

In one embodiment, the Li-based water resistant additive includes one or more selected from lithium carbonate, lithium silicate, lithium hydroxide, lithium sulfate, lithium bromide, and lithium acetate. The Li-based water resistant additive is stable at room temperature and has a low viscosity even when $SiO_2$ has a concentration as high as the water glass and a molar ratio is close to 8. Furthermore, the Li-based water resistant additive has a mixed alkali effect with Na ions in the water glass, and, thus, the chemical durability of the finished inorganic binder can be increased and the water resistance can be improved. Herein, if the Li-based water resistant additive is included in an amount of more than 10 parts by weight, a network structure of the inorganic binder collapses, resulting in a decreased in the chemical durability and the water resistance. Therefore, preferably, the Li-based water resistant additive may be included in an amount of 0.1 to 10 parts by weight in the inorganic binder of the present disclosure.

In one embodiment, the organic silicon compound includes an organic functional group chemically bonded to an organic material and a hydrolysis group which can react with an inorganic material in the same molecule, so that the organic silicon compound can combine the organic material with the inorganic material. Thus, the mechanical strength and the water resistance of the inorganic binder of the present disclosure can be increased and the quality thereof can be improved, so that the organic silicon compound endows a hydrophobic property. Preferably, the organic silicon compound may include one or more selected from tetraethoxysilane, methyltriethoxysilane, sodium methylsiliconate, methyltrimethoxysilane, potassium methylsiliconate, butyltrimethoxysilane, and vinyltrimethoxysilane. More preferably, the organic silicon compound may be included in an amount of 0.1 to 10 parts by weight in the inorganic binder. This is because if the organic silicon compound is included in an amount of more than 10 parts by weight, the price of the inorganic binder may be increased and the property of the finally finished inorganic binder composition may deteriorate.

In one embodiment, the anti-sand burning additive includes one or more selected from monosaccharides, polysaccharides, and disaccharides. Preferably, the monosaccharides may include one or more selected from dextrose, fructose, mannose, galactose, and ribose; the polysaccharides may include one or more selected from starch, glycogen, cellulose, chitin, and pectin; and the disaccharides may include one or more selected from maltose, sugar, and lactose. Furthermore, in one embodiment, the inorganic binder composition may further include an inorganic additive or a curing agent so as to further improve the strength, flexibility, and hardness of the inorganic binder. In this case, preferably, the curing agent may include one or more selected from sodium hydroxide, sodium carbonate, potassium hydroxide, potassium carbonate, sodium phosphate, disodium phosphate, trisodium phosphate, and sodium sulfate. Furthermore, the amount of the added curing agent is excessive, a hydrophilic property of the inorganic binder is increased, resulting in a decrease in the water resistance of the inorganic binder. Thus, more preferably, the curing agent may be included in an amount of 0.1 to 5.0 parts by weight with respect to the total weight of the inorganic binder composition.

As such, since the inorganic binder composition of the present disclosure includes the nano-silica, the Li-based water resistant additive, the organic silicon compound, and saccharides as additives in the water glass, the inorganic binder composition increases a binding force in the binder composition, resulting in an improvement in the strength of the binder and the water resistance and the water repellency of the binder composition together with an increase in a binding force with water. Thus, the inorganic binder composition can be completely dissolved in an aqueous solution. In this regard, FIG. 1 shows a photo of an inorganic binder dissolved in an aqueous solution prepared according to one embodiment of the present disclosure. Referring to FIG. 1, an excellent solubility of the binder composition of the present disclosure can be seen. Since the inorganic binder composition is completely dissolved in an aqueous solution when a core is manufactured by using the inorganic binder composition of the present disclosure, a binding force with sand can be improved when the core is manufactured and it is possible to manufacture a core and a cast which are excellent in strength and water resistance and in which sand burning is prevented.

In particular, the present disclosure satisfies the requirements for water resistance and strength at a high temperature and a high humidity. Thus, the present disclosure has a strength of 60% or more with respect to an initial strength after an exposure at a temperature of 30 to 40° C. and a relative humidity of 60 to 70% (absolute humidity of 20 to 30 g/m$^3$) for 3 hours.

Figure 2:
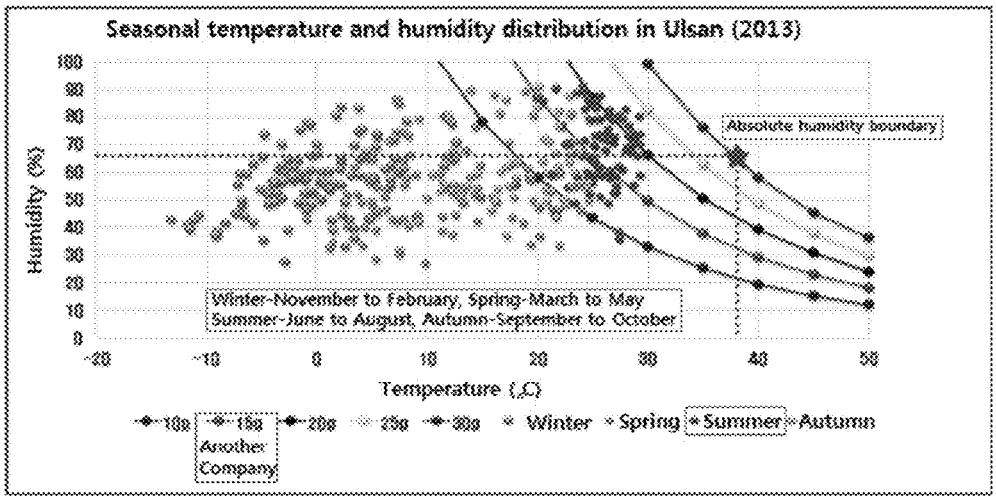
FIG. 2 is a graph illustrating seasonal temperature and humidity distribution of Ulsan in 2013.

FIG. 2 illustrates seasonal temperature and humidity distribution of Ulsan (South Korea) in 2013. Referring to FIG. 2, it can be seen that a core and a cast manufactured by the inorganic binder produced by another company are broken at an absolute humidity of 15 g/m$^3$ or more, whereas a core and a cast manufactured by the inorganic binder of the present disclosure maintains a handling strength at an absolute humidity of 30 g/m$^3$.

Accordingly, more preferably, the present disclosure may have a strength of 60% or more with respect to an initial strength after an exposure at a temperature of 38° C. and a relative humidity of 65% (absolute humidity of 30 g/m$^3$) for 3 hours.

According to another aspect, the present disclosure provides a core manufactured by using the inorganic binder composition for casting.

According to yet another aspect, the present disclosure provides a cast manufactured so as to include the core.

Since the inorganic binder composition for casting includes all of the Li-based water resistant additive, the nano-silica, the organic silicon compound, and the anti-sand burning additive in the water glass, the core and the cast manufacture by using the inorganic binder composition are improved in strength, fluidity, water resistance, sand removal, and sand burning.

Hereinafter, the present disclosure will be described in detail with reference to Examples, but a scope of the present disclosure is not limited thereto.

Example 1

Preparation of Water Glass Constituting Inorganic Binder

If the amount of Si in an inorganic binder is increased, the hardness and strength will be increased during a curing process. However, viscosity and flexibility as properties of resin, an inorganic binder solid, workability are decreased, so that the inorganic binder may have the properties similar to glass. If the amount of Na is increased, the solubility with respect to water will be increased. Thus, the properties of the inorganic binder are good, but during a drying process, its physical properties such as water resistance, strength, and hardness deteriorate.

Thus, in the present Example, the water glass was prepared in consideration of the above-described properties, and the components thereof were analyzed by XRF as listed in the following Table 1.

TABLE 1

| Component | Example 1 |
|---|---|
| Si | 79.8 |
| Na | 19.7 |
| Al | 0.24 |
| K | 0.17 |
| Fe | 0.08 |

Example 2

Change in Hygroscopic Property of Inorganic Binder Caused by Mixing with Additive

Example 2-1

Mixing with Li-based Water Resistant Additive

A Li-based water resistant additive was added into the water glass prepared in Example 1 so as to synthesize an inorganic binder. Then, a hygroscopic property was evaluated. After a sample in a predetermined amount (0.05 g) was dried, the weight was measured. Then, 20 ml of distilled water was added and deposition of the sample was allowed. After 48 hours, the amount (%) of the remaining inorganic binder was observed to check a change in a hygroscopic property of the inorganic binder. The result thereof was as listed in the following Table 2.

TABLE 2

| Component Name | Sample 1 | Sample 2 | Sample 3 | Sample 4 |
|---|---|---|---|---|
| Water glass | 95 | 90 | 85 | 80 |
| Li-based water resistant additive | 5 | 10 | 15 | 20 |
| Binder residual rate (%) | 8.23 | 91.16 | 98.83 | 98.47 |
| Viscosity (cps) | 32 | 42 | 456 | 1460 |

Example 2-2

Mixing with Nano-Silica

Nano-silica was added into the water glass prepared in Example 1 so as to synthesize an inorganic binder. Then, a hygroscopic property was evaluated by the same method as Example 2-1. The result thereof was as listed in the following Table 3.

TABLE 3

| Component Name | Sample 5 | Sample 6 | Sample 7 | Sample 8 |
|---|---|---|---|---|
| Water glass | 90 | 80 | 70 | 60 |
| Nano-silica | 10 | 20 | 30 | 40 |
| Binder residual rate (%) | 3.63 | 8.23 | 98.27 | 99.64 |
| Viscosity (cps) | 22 | 42 | 234 | 1840 |

Example 2-3

Mixing with Organic Silicon Compound

An organic silicon compound was added into the water glass prepared in Example 1 so as to synthesize an inorganic binder. Then, a hygroscopic property was evaluated by the same method as Example 2-1. The result thereof was as listed in the following Table 4.

TABLE 4

| Component Name | Sample 9 | Sample 10 | Sample 11 | Sample 12 |
|---|---|---|---|---|
| Water glass | 95 | 90 | 85 | 80 |
| Organic silicon compound | 5 | 10 | 15 | 20 |
| Binder residual rate (%) | 8.23 | 4.56 | 10.7 | 10.76 |
| Viscosity (cps) | 62 | 42 | 32 | 16 |

In Example 2, a hygroscopic property of the inorganic binder when being mixed with an additive was evaluated.

In Example 2-1, the inorganic binder was synthesized by adding the Li-based water resistant additive into the water glass. Referring to Table 2, it can be seen that as the amount of the Li-based water resistant additive increases, the binder residual rate and the viscosity is increased. Accordingly, it can be seen that as the amount of the Li-based water resistant additive increases, the water resistance and the viscosity is increased.

Furthermore, in Example 2-2, the inorganic binder was synthesized by adding the nano-silica into the water glass. Referring to Table 3, it can be seen that as the amount of silicon constituting the inorganic binder increases, the binder residual rate and the viscosity is increased. Accordingly, it can be seen that as the amount of the nano-silica increases, the water resistance and the viscosity is increased.

Furthermore, in Example 2-3, the inorganic binder was synthesized by adding the organic silicon compound into the water glass. Referring to Table 4, it can be seen that a change in the binder residual rate according to a change in the amount of the organic silicon compound is small, the organic silicon compound does not greatly contribute to an improvement in the water resistance of the inorganic binder, but as the amount of the organic silicon compound increases, the viscosity decreases.

Example 3

Evaluation of Improvement in Sand Burning of Inorganic Binder

Example 3-1

Inorganic Binder without Including Anti-Sand Burning Additive

An inorganic binder was prepared by adding a Li-based water resistant additive, nano-silica, and an organic silicon compound into the water glass prepared in Example 1 and synthesizing them. A core was manufactured by using the prepared inorganic binder and Vietnam sand AFS 55, and a core sample having a rectangular shape of 175×22.4×22.4 mm (L×W×H) was manufactured by mixing the binder of 1 to 4% with respect to the sand. Then, a low-pressure casting process was performed to check whether or not sand burning occurs.

Figure 3:
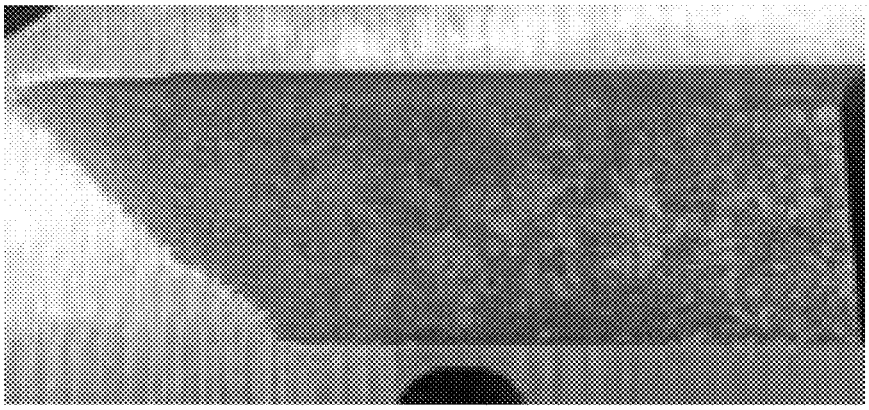
FIG. 3 is a photo of a core manufactured by using an inorganic binder without including an anti-sand burning additive according to one embodiment of the present disclosure.

The result thereof was as illustrated in FIG. 3.

Referring to FIG. 3, it can be seen that the binder is in liquid form based on the water glass and lacks a thermal property and thermal resistance. Thus, there occurs sand burning that sand remains on a metal surface.

Example 3-2

Inorganic Binder Including Anti-sand Burning Additive

The binder prepared in Example 3-1 was synthesized with monosaccharides or polysaccharides of 1 to 10% as an anti-sand burning additive, and then, a sample was prepared by the same method as Example 3-1 and a low-pressure casting process was performed to test sand burning.

Figure 4:
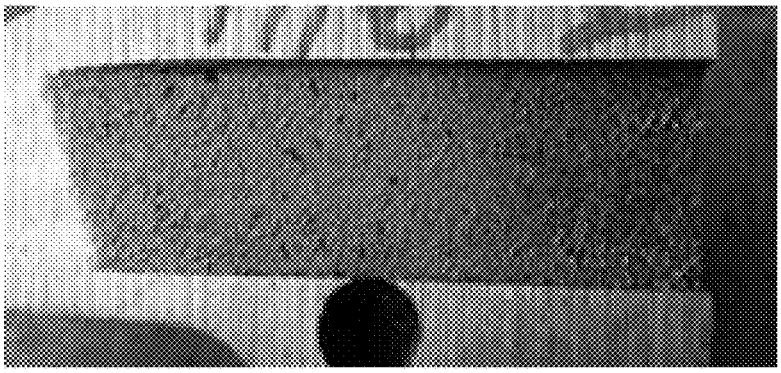
FIG. 4 is a photo of a core manufactured by using an inorganic binder including an anti-sand burning additive formed of monosaccharides according to one embodiment of the present disclosure.
Figure 5:
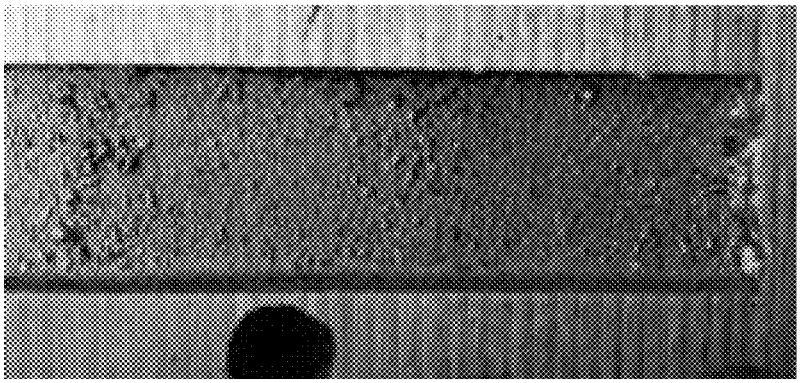
FIG. 5 is a photo of a core manufactured by using an inorganic binder including an anti-sand burning additive formed of polysaccharides according to one embodiment of the present disclosure.

The result thereof was as illustrated in FIG. 4 and FIG. 5. FIG. 4 illustrates a case where monosaccharides are added, and FIG. 5 illustrates a case where polysaccharides are added. Referring to FIG. 4 and FIG. 5, it can be seen that sand burning does not occur in the inorganic binders respectively including the monosaccharides and the polysaccharides as an anti-sand burning additive. It is deemed that the added polysaccharides and monosaccharides are carbonized at the time of being in contact with molten metal, thereby reducing surface energy on a surface of the cast and thus preventing occurrence of sand burning.

Example 4

Change in Strength of Core Manufactured by Using Inorganic Binder

After cores were manufactured by using the inorganic binders prepared in Example 2-1 to Example 2-3, the change in strength of each core was measured. That is, the cores were manufactured with respect to the samples 1 to 12 manufactured using the inorganic binders prepared by adding each of the Li-based water resistant additive, the nano-silica, and the organic silicon compound in Example 2-1 to Example 2-3.

Furthermore, inorganic binders were prepared so as to include all of the Li-based water resistant additive, the nano-silica, the organic silicon compound, and the anti-sand burning additive by adding the Li-based water resistant additive, the nano-silica, and the organic silicon compound into the samples 1 to 12 prepared by Example 2-1 to Example 2-3 and mixing them with the anti-sand burning additive. Then, cores were manufactured by using the inorganic binders, and a change in strength was measured.

For manufacturing of the cores and measurement of a change in strength, mixed sand was prepared by mixing each of the inorganic binders of 1 to 4% with respect to Vietnam sand AFS 55 in a molding sand mixer (YOUNGJIN MACHINERY CO., LTD), and the prepared mixed sand was manufactured into a core having a rectangular shape of 175×22.4×22.4 mm (L×W×H) by using a core making machine (YOUNGJIN MACHINERY CO., LTD) for casting. Then, a compressive strength test was conducted according to KS A 5304.

Example 4-1

Measurement of Strength of Core Depending on Amount of Li-based Water Resistant Additive Cores were manufactured by using the inorganic binder samples 1 to 4 synthesized by varying the amount of the Li-based water resistant additive of Example 2-1. The cores manufactured by using the samples were labelled as Core 1 to Core 4, respectively. The strength of each of the cores was measured and illustrated in FIG. 6.

Figure 6:
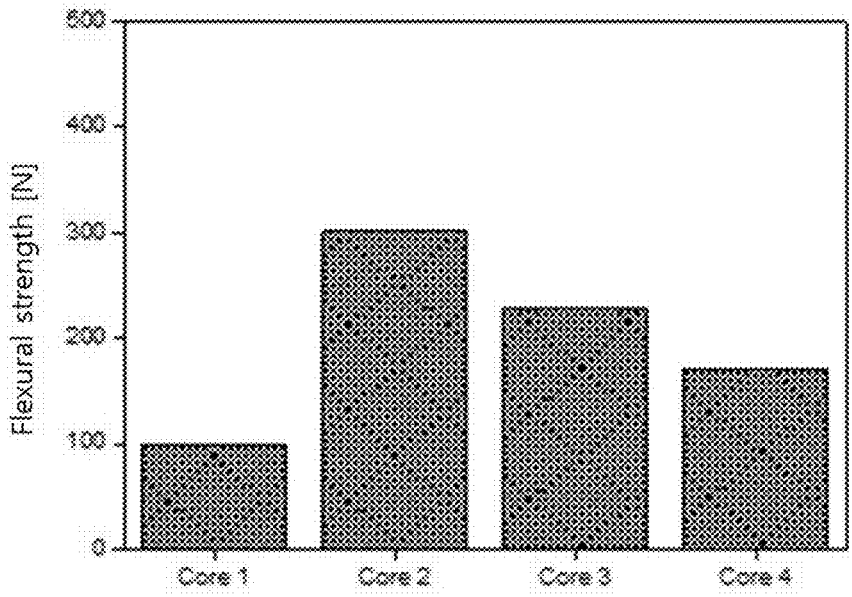
FIG. 6 is a graph illustrating the strength of cores manufactured by inorganic binders in which a Li-based water resistant additive is mixed according to one embodiment of the present disclosure.

Referring to FIG. 6, as the strength of the core increases due to the Li-based water resistant additive, it can be seen that the strength of Core 2 was increased by three times as compared with the strength of Core 1. Meanwhile, it can be seen that even when Core 3 has the greater amount of the Li-based water resistant additive than Core 2 but has the lower strength than Core 2. It is deemed that as can be seen from Example 2-1, as the amount of the Li-based water resistant additive increases, the viscosity of the inorganic binder increases and thus the fluidity of the sand decreases, resulting in a decrease in filling ability of the core.

Example 4-2

Measurement of Strength of Core Depending on Amount of Nano-silica

Cores were manufactured by using the inorganic binder samples 5 to 8 synthesized by varying the amount of the nano-silica of Example 2-2. The cores manufactured by using the samples were labelled as Core 5 to Core 8, respectively. The strength of each of the cores was measured and illustrated in FIG. 7.

Figure 7:
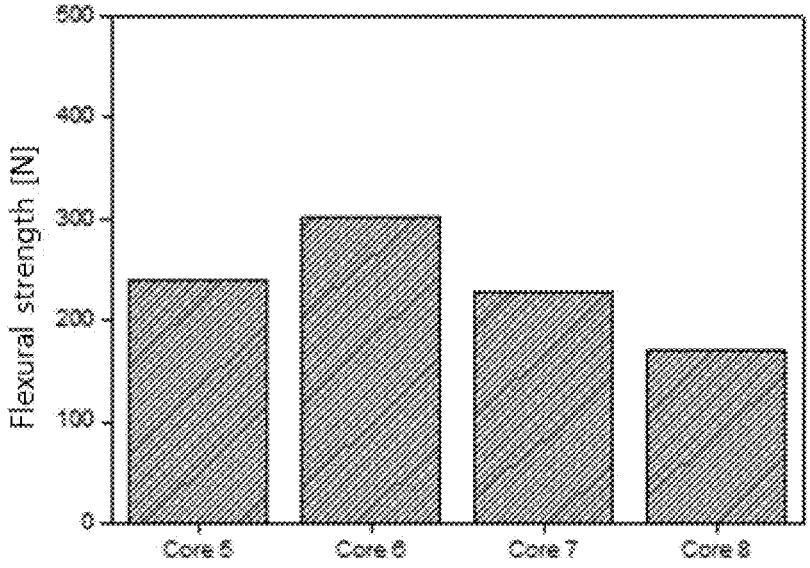
FIG. 7 is a graph illustrating the strength of cores manufactured by inorganic binders in which nano-silica is mixed according to one embodiment of the present disclosure.

Referring to FIG. 7, it can be seen that an increase in the amount of the nano-silica improved the strength of core but if the amount of the nano-silica is more than a predetermined amount, the strength decreases. It is deemed that as can be seen from Example 2-2, as the amount of the nano-silica increases, the viscosity increases and silica particles in an excessive amount are present, and, thus, a curing process of the inorganic binder is inhibited. Furthermore, it is deemed that the nano-silica in an excessive amount does not sufficiently react during a synthesizing process of the inorganic binder.

Example 4-3

Measurement of Strength of Core Depending on Amount of Organic Silicon Compound

Cores were manufactured by using the inorganic binder samples 9 to 12 synthesized by varying the amount of the organic silicon compound of Example 2-3. The cores manufactured by using the samples were labelled as Core 9 to Core 12, respectively. The strength of each of the cores was measured and illustrated in FIG. 8.

Figure 8:
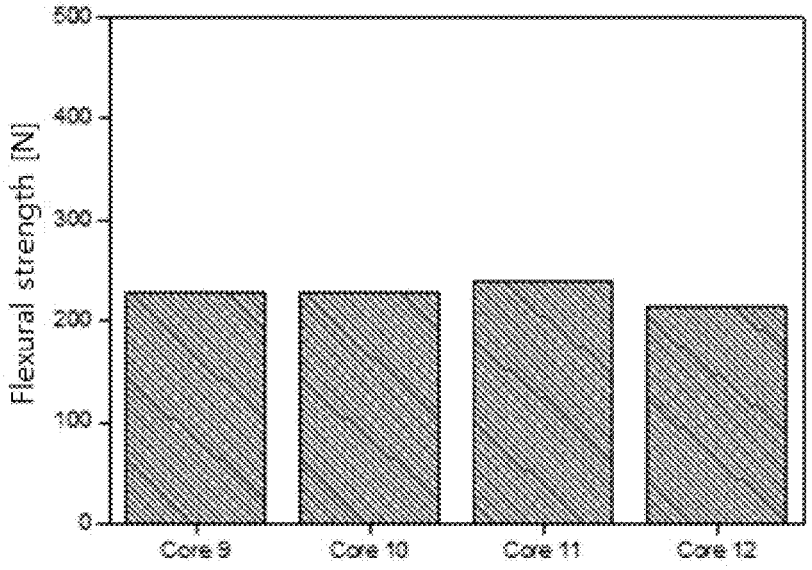
FIG. 8 is a graph illustrating the strength of cores manufactured by inorganic binders in which an organic silicon compound is mixed according to one embodiment of the present disclosure.

Referring to FIG. 8, it can be seen that the amount of the organic silicon compound does not greatly affect the strength of the core. However, as can be seen from Table 4 of Example 2-3, as the amount of the organic silicon compound increases, the viscosity decreases. Therefore, it is deemed that it is necessary to mix an appropriate amount of the organic silicon compound in order to manufacture the core having a fluidity required for core molding.

Example 4-4

Measurement of Strength of Core Depending on Inclusion of Li-based Water Resistant Additive, Nano-silica, Organic Silicon Compound, and Anti-sand Burning Additive The inorganic binder including all of the Li-based water resistant additive, the nano-silica, the organic silicon compound, and the anti-sand burning additive by adding the Li-based water resistant additive, the nano-silica, and the organic silicon compound into the samples 1 to 12 prepared in Example 2-1 to Example 2-3 and mixing them with the anti-sand burning additive, and then, cores were manufactured by using the inorganic binders.

The manufactured cores were labelled as Core 13 to Core 16, respectively, and the results of measurement of composition and strength of each core were as listed in the following Table 5 and illustrated in FIG. 9.

TABLE 5

| Core Name | Core 13 | Core 14 | Core 15 | Core 16 |
|---|---|---|---|---|
| Added Inorganic Binder | Sample 1 + Sample 5 + Sample 9 + Anti-sand burning additive | Sample 1 + Sample 6 + Sample 9 + Anti-sand burning additive | Sample 2 + Sample 6 + Sample 10 + Anti-sand burning additive | Sample 1 + Sample 6 + Sample 10 + Anti-sand burning additive |

Figure 9:
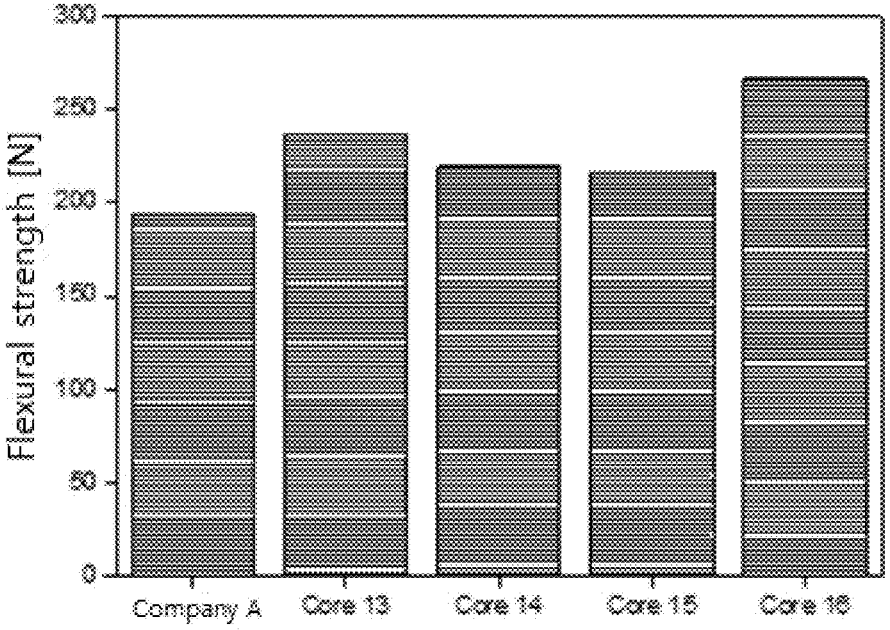
FIG. 9 is a graph illustrating the strength of cores manufactured by inorganic binders in which all of a Li-based water resistant additive, nano-silica, an organic silicon compound, and an anti-sand burning additive are mixed according to one embodiment of the present disclosure.

Referring to Table 5 and FIG. 9, the inorganic binder manufactured by adding the additive has a higher strength than the conventionally used inorganic binder (German Company A). It is deemed that this is because the additives are mutually complemented so as to improve the strength of the core.

Example 5

Change in Water Resistance of Core Manufactured by Using Inorganic Binder

Core 13 to Core 16 as the cores manufactured in Example 4-4 were left for 3 hours in a thermohygrostat with an absolute humidity of 30 g/m$^3$ at a temperature of 38° C. and a humidity of 65%. Then, the strength of each core was measured to check the water resistance of the core.

Figure 10:
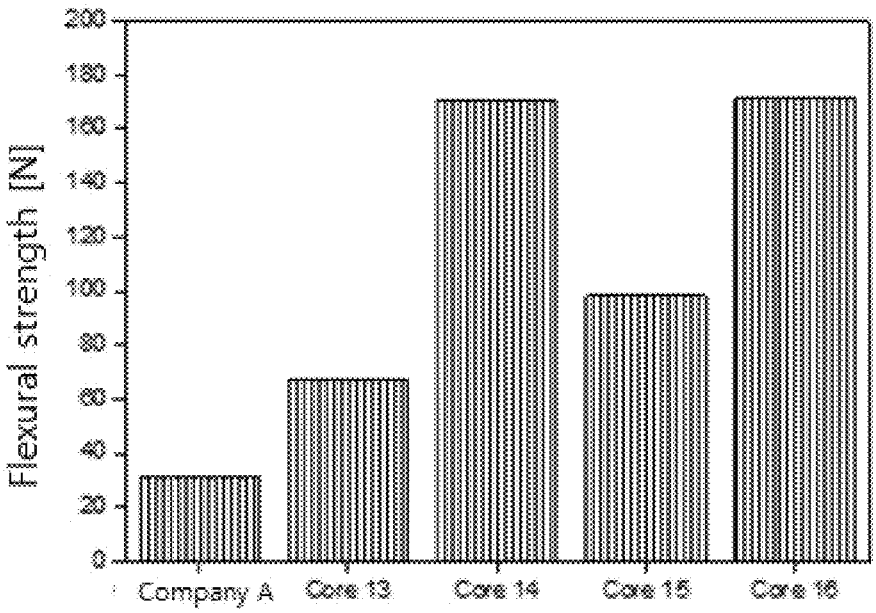
FIG. 10 is a graph illustrating the water resistance of cores manufactured by inorganic binders in which all of a Li-based water resistant additive, nano-silica, an organic silicon compound, and an anti-sand burning additive are mixed according to one embodiment of the present disclosure.

The result thereof was as illustrated in FIG. 10.

Referring to FIG. 10, it can be seen that the conventionally used inorganic binder (German Company A) is weak in water resistance and when it is left for 3 hours at an absolute humidity of 30 g/m$^3$, it is broken by its own weight and decreased in strength, and, thus, cannot be used. Meanwhile, the core manufactured by the inorganic binder including all of the Li-based water resistant additive, the nano-silica, the organic silicon compound, and the anti-sand burning additive has a higher strength than the conventionally used inorganic binder (German Company A) as a result of the moisture absorption test, and is not broken by its own weight.

In particular, Core 14 and Core 16 exhibited excellent water resistance.

Example 6

Evaluation of Property of Core Manufactured by Using Inorganic Binder

Figure 11:
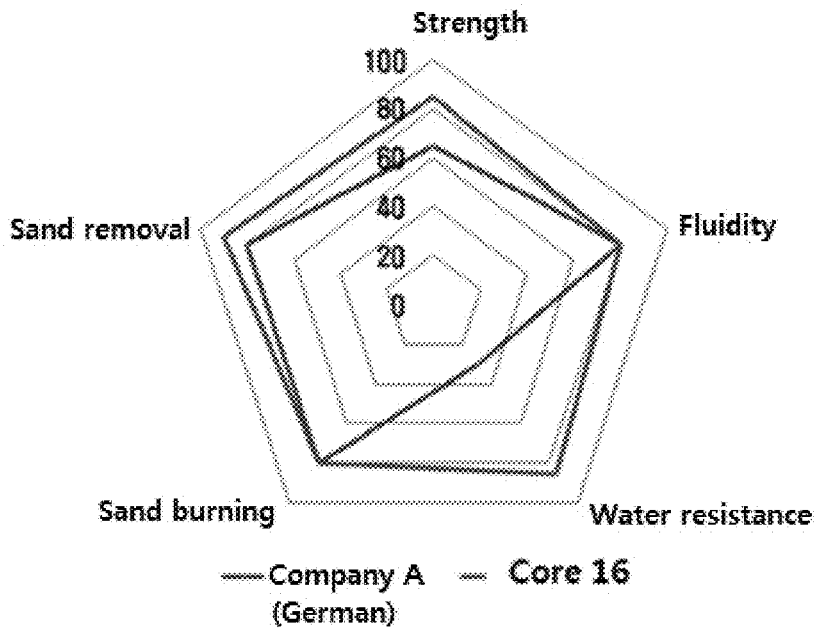
FIG. 11 is a graph illustrating properties of a core manufactured according to one embodiment of the present disclosure and a core manufactured by using a conventionally commercialized inorganic binder.

Core 16 as the core manufactured in Example 4-4 and the core manufactured by using the conventional product of German Company A were compared in properties, and the result thereof was as listed in Table 6 and illustrated in FIG. 11.

TABLE 6

| Classification | German Company A | Core 16 |
|---|---|---|
| Strength [Flexural Strength N/cm$^2$] | 172.9 | 233.3 |
| Fluidity | Good | Good |
| Water Resistance [Absolute Humidity 30 g/m$^3$] | 1 hr | 3 hr |
| Sand Burning | Good | Good |
| Sand Removal | Good | Excellent |

Referring to Table 6 and FIG. 11, it can be seen that Core 16 as the core manufactured by using the inorganic binder including all of the Li-based water resistant additive, the nano-silica, the organic silicon compound, and the anti-sand burning additive has the generally improved physical properties as compared with the core of German Company A.

That is, it can be seen that Core 16 as the core manufactured using the inorganic binder of embodiment has an excellent strength of 233.3 N/cm$^2$ which is increased by 60.4 N/cm$^2$ as compared with the core of German Company A, and has the improved physical properties in terms of fluidity, sand burning, and sand removal.

In particular, it can be seen that in terms of water resistance, Core 16 as the core manufactured using the inorganic binder of the present disclosure has an excellent strength even after being left for 3 hours at an absolute humidity of 30 g/m$^3$ and is not broken by its own weight, whereas the core of German Company A has an excellent strength after being left only for 1 hour in the same condition. Accordingly, it can be seen that the core manufactured by using the inorganic binder of the present disclosure is remarkably improved in water resistance as compared with the conventional core of German Company A.

Referring to the above-described results, it is deemed that since the inorganic binder for casting according to the present disclosure includes all of the Li-based water resistant additive, the nano-silica, the organic silicon compound, and the anti-sand burning additive in the water glass, the strength and the water resistance can be improved while maintaining the fluidity and sand can be easily removed by preventing occurrence of sand burning, and, thus, work efficiency can be improved and the inorganic binder can be commercialized.

Furthermore, it is deemed that since the inorganic binder of the present disclosure is used, the eco-friendly cast and core generally improved in strength, fluidity, water resistance, sand removal, and sand burning can be manufactured.

According to the present disclosure, the inorganic binder composition for casting supplements the strength and water resistance by increasing an amount of Si while maintaining the fluidity of mixed sand when a sand cast and a core are manufactured, and, thus, work efficiency is improved and the inorganic binder can be commercialized.

Furthermore, as the inorganic binder is used, the sand cast and the core can be eco-friendly manufactured.

Furthermore, as the inorganic binder composition for casting according to the present disclosure is used, surface energy between molten metal and a cast is decreased when the cast is manufactured and sand burning is prevented by carbonization of saccharides caused by the hot molten metal.

While the present disclosure has been described with respect to the specific embodiments, it will be apparent to those skilled in the art that various changes and modifications may be made without departing from the spirit and scope of the invention as defined in the following claims.

What is claimed is:

1. An inorganic binder composition for casting, comprising:

water glass of 40 to 70 parts by weight;

nano-silica of 5 to 35 parts by weight;

a Li-based water resistant additive of 0.1 to 10 parts by weight;

an organic silicon compound of 0.1 to 10 parts by weight; and an anti-sand burning additive of 1 to 10 parts by weight.

2. The inorganic binder composition for casting according to claim 1, wherein the water glass includes $SiO_2$ of 25 to 36 weight % and $Na_2O$ of 7 to 15 weight %.

3. The inorganic binder composition for casting according to claim 1, wherein the Li-based water resistant additive includes one or more selected from lithium carbonate, lithium silicate, lithium hydroxide, lithium sulfate, lithium bromide, and lithium acetate.

4. The inorganic binder composition for casting according to claim 1, wherein the organic silicon compound includes one or more selected from methyltriethoxysilane, sodium methylsiliconate, methyltrimethoxysilane, potassium methylsiliconate, butyltrimethoxysilane, and vinyltrimethoxysilane.

5. The inorganic binder composition for casting according to claim 1, wherein the anti-sand burning additive includes one or more selected from monosaccharides, polysaccharides, and disaccharides.

6. A core manufactured utilizing an inorganic binder composition of claim 1.

7. A cast manufactured so as to include a core of claim 6.

* * * * *